United States Patent [19]

Williams

[11] Patent Number: 4,936,532

[45] Date of Patent: Jun. 26, 1990

[54] BALLOON CLOSURE AND HANGER DEVICE

[76] Inventor: Jesse Williams, 5712 Farragut Rd., Brooklyn, N.Y. 11234

[21] Appl. No.: 377,569

[22] Filed: Jul. 10, 1989

[51] Int. Cl.[5] ..... A47B 96/06

[52] U.S. Cl. ..... 248/205.3; 24/30.5 S; 24/130; 446/222

[58] Field of Search ..... 248/205.3; 446/220, 446/222, 223, 224, 901; 24/305 S, 570, 130, 129 R

[56] References Cited

U.S. PATENT DOCUMENTS

| | | | |
|---|---|---|---|
| 1,366,708 | 1/1921 | Sprague, Jr. | 24/570 |
| 1,635,835 | 7/1927 | Good | 446/223 |
| 2,246,229 | 6/1941 | Wohlmuth | 24/130 |
| 2,396,906 | 3/1946 | Windson | 446/222 |
| 2,510,883 | 6/1950 | Goldberg | 446/222 X |
| 3,092,388 | 6/1963 | Wagenheim | 446/220 X |
| 3,178,138 | 4/1965 | Hessdoerfer et al. | 248/205.3 X |
| 3,366,999 | 2/1968 | Darby | 446/222 |

FOREIGN PATENT DOCUMENTS

| | | | |
|---|---|---|---|
| 709270 | 5/1954 | United Kingdom | 446/223 |

*Primary Examiner*—David L. Talbott
*Attorney, Agent, or Firm*—Iman Abdallah

[57] ABSTRACT

A balloon closure and hanger device of unitary construction comprising a closure tab and support tab, said closure tab and support tab being integrally constructed at each end of an angularly disposed central portion, said closure tab having slots formed therein for receipt of the stem of an inflated balloon, said support tab having means to mount said device to a ceiling, wall or the like.

3 Claims, 1 Drawing Sheet

BALLOON CLOSURE AND HANGER DEVICE

BACKGROUND OF THE INVENTION

The present invention generally relates to closure devices for balloons flexible tubing and the like. More particularly, the present invention relates to means for temporary sealing of balloons and the like in combination with means for temporarily supporting such balloons and the like.

Various means are known in the prior art to seal an inflated balloon For example, U.S. Pat. No. 4,428,149 to Brown discloses a toy balloon closure device comprising a tubular configuration having longitudinal slot and a central hole formed therein, said balloon being disposed through said central hole and longitudinal slot and twisted thereby utilizing the tension of said twisted balloon to seat and firmly support the balloon against the closure device. The utility of such device is limited by the requirement that the attached balloon remain twisted within the device in order for the balloon to remain inflated. Thus the balloon cannot be fondled or otherwise handled and remain inflated. U.S. Pat. No. 4,416,038 to Morrone discloses a balloon closure device comprising a pair of hingedly interconnected legs having interlocking closure members formed on the inner surfaces of said legs defining a tortuous path through which a balloon stem extends permitting clamping engagement of the stem of the balloon U.S. Pat. No. 4,380,103 to McGrath et al. discloses a balloon clip of unitary construction providing balloon sealing by engagement of the stem of a balloon within an interior clamping area of the clip, said clip clamping said balloon by engagement of substantially C-shaped flanges with each other. Another device for sealing an inflated balloon is disclosed in U.S. Pat. No. 1,680,318 to Callahan which comprises a substantially rigid disk having slots formed at opposite positions on its periphery for receipt of the stem of a balloon said balloon being twisted after insertion within one slot and prior to insertion within a second slot to prevent the escape of air from the inflated balloon. Neither of the balloon sealing devices heretofore described provide means to support the balloon from a wall, ceiling or the like.

In U.S. Pat. No. 3,250,241 to Levy et al. balloon support means are described comprising a support post having an extending loop and double-bend portion, said support post being attachable to a suction cup which provides means to retain the attached balloon in a stationary position. The balloon is secured to the support post by inserting its stem through the extending loop, wrapping it around said double-bend portion and anchoring the stem in a bend of the post. Another balloon hanger device is disclosed in U.S. Pat. No. 2,931,133 to Dodson comprising a singular resilient wire or wire like element formed in a U-shaped base portion at one end, and a continuous ring or loop, or in the alternative a hook, formed at the other end, a plurality of parallel return bent portions being formed intermediate of the end portions. The hanger device of the Dodson invention is directed to its use with a wire or cord upon which the hanger device is supported.

SUMMARY OF THE INVENTION

The device of the present invention provides in combination balloon closure means and hanger support means in a unitary construction comprising a closure portion consisting of a flat, rectangular tab having peripheral slots formed at right angles to each other therewithin, and a support portion consisting of a flat tab having a curved free edge including removable two-sided sticky tape disposed on one side thereof, said closure portion and said support portion each being integrally constructed at one end with an angularly disposed central portion.

An object of this invention is to provide a simple device of unitary construction for sealing and hanging of an inflated balloon.

Another object of this invention is to provide a reusable balloon sealing and hanging device.

It is also an object of the present invention to provide a sealing and hanging device which permits repeated use of the attachable balloon These and other objects of the present invention will be apparent to those skilled in the art from the following description, drawings and claims.

DESCRIPTION OF A PREFERRED EMBODIMENT

Figure 1:
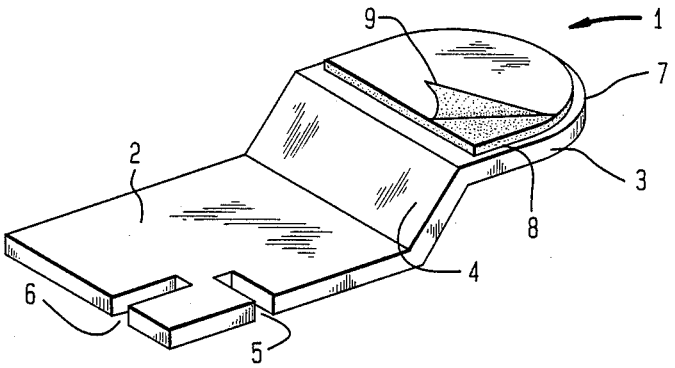
FIG. 1 is a top perspective view of the device of the present invention.

In FIG. 1 there is shown a top perspective view of the balloon closure and hanger device 1 of the present invention. Device 1 can be seen to include a closure portion 2 and a support portion 3 respectively and integrally constructed at each end of a central portion 4. The central portion 4 of the device 1 is angularly disposed between the closure portion 2 and the support portion 3. Closure portion 2 is substantially a flat, rectangular tab having a first slot 5 formed at one side of the closure portion 2 and a second slot 6 formed at the free end of said closure portion 2. Support portion 3 is substantially a flat tab having a curved free edge 7. As can be best seen in FIG. 2 the closure portion 2 and support portion 3 extend in opposite directions and in parallel alignment at respective ends of the angularly disposed central portion 4. Support portion 3 further includes two-sided sticky tape 8 complimentarily shaped to the support portion 3 and disposed on the top surface thereof. Sticky tape 8 is covered by a tape seal 9, preferably constructed of paper, to facilitate protection of the surface of the sticky tape 8 when the device 1 is not being used.

Figure 2:
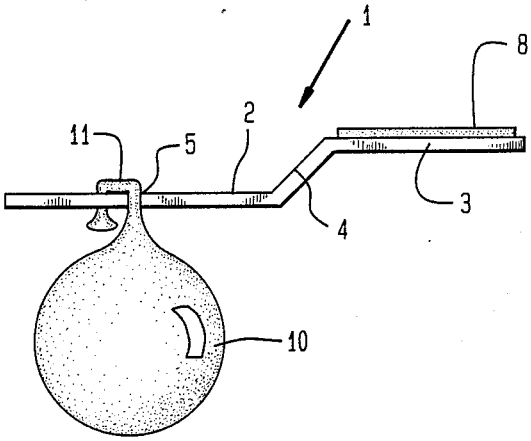
FIG. 2 is a side elevational view of the device shown with an inflated balloon inserted therein.
Figure 3:
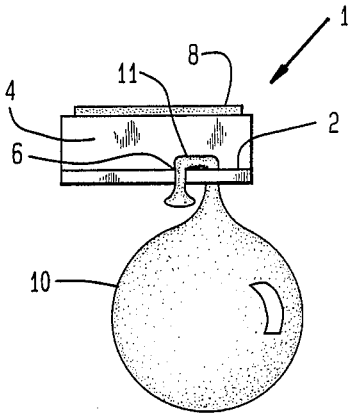
FIG. 3 is an end elevational view of the device shown with an inflated balloon inserted therein.

As can be seen in FIGS. 2 and 3 an inflated balloon 10 is sealed within device 1 by inserting the stem 11 of the balloon 10 within the first slot 5, extending the stem 11 of the balloon 10 across the top surface of the closure portion 2 and then inserting the stem 11 within the second slot 6. Slots 5 and 6 are sufficiently narrow to cause the pinching of the stem 11 when inserted therein thereby preventing the escape of air from the inflated balloon 10.

With the device 1 constructed as heretofore described and an inflated balloon 10 inserted in slots 5 and 6, the device may be mounted to a ceiling, wall or the like by removing the tape seal 9 and pressing the surface of the sticky tape 8 to the surface of the ceiling, wall or the like to which it is to be mounted. The disposition of the closure portion 2 and the support portion 3 in parallel planes at the ends of central portion 4 permits the attachment of a balloon 10 in close proximity with the ceiling, wall or the like when the device 1 is mounted. Thus a deflated or bursted balloon 10 can be replaced without removing the device 1 from the wall. The balloon 10 and closure and hanger device 1 may be subsequently removed from the ceiling or wall and the tape 8 repeatedly replaced by replacing the two-sided sticky tape 8.

Therefore in view of the foregoing, what is claimed is:

1. A balloon closure and hanger device of unitary construction comprising a closure tab and a support tab, said closure tab and said support tab being integrally constructed at respective ends of an angularly disposed central portion, said closure tab being a substantially flat and rectangular member having a first slot formed at one side of the closure tab and a second slot formed at the free end of said closure tab, said first and second slots being constructed sufficiently narrow to pinch the stem of a balloon disposed therein, said support tab being a substantially flat member having a curved free end, said closure tab and said support tab extending in opposite directions from said central portion in parallel alignment, said balloon closure and hanger device further including means to mount said device to a ceiling, wall or the like.

2. A balloon closure and hanger device as disclosed in claim 1 wherein said means to mount said device comprises removable two-sided sticky tape disposed on the top surface of said support tab and complimentarily shaped with the support tab of said device thereby providing mounting means by pressing the top surface of said sticky tape to the ceiling, wall or the like to which it is to be mounted.

3. A balloon closure and hanger device as disclosed in claim 2 further including a tape seal disposed adjacent to the top surface of said sticky tape.

* * * * *